US006451221B1

(12) United States Patent
Hart et al.

(10) Patent No.: US 6,451,221 B1
(45) Date of Patent: Sep. 17, 2002

(54) EXTRUDABLE MAGNET COMPOUND WITH IMPROVED FLOW PROPERTIES

(75) Inventors: Steven C. Hart, Ontario; Lois A. Eckstrom, Williamson, both of NY (US)

(73) Assignee: Xerox Corporation, Stamford, CT (US)

( * ) Notice: Subject to any disclaimer, the term of this patent is extended or adjusted under 35 U.S.C. 154(b) by 36 days.

(21) Appl. No.: 09/749,580

(22) Filed: Dec. 28, 2000

(51) Int. Cl.[7] ..... H01F 1/08

(52) U.S. Cl. ..... 252/62.54; 252/62.55; 428/404; 428/403

(58) Field of Search ..... 252/62.54, 62.55; 428/403, 404

(56) References Cited

U.S. PATENT DOCUMENTS 5,278,018 A * 1/1994 Young et al. ..... 430/110

5,888,416 A 3/1999 Ikuma et al. ..... 252/62.54

FOREIGN PATENT DOCUMENTS

| | | |
|---|---|---|
| JP | 60-194503 | 10/1985 |
| JP | 60-211908 | 10/1985 |
| JP | 62-123702 | 6/1987 |
| JP | 62-152107 | 7/1987 |

* cited by examiner

*Primary Examiner*—C. Melissa Koslow
(74) *Attorney, Agent, or Firm*—Oliff & Berridge, PLC

(57) ABSTRACT

An extrudable magnet composition includes composite particles including thermoplastic resin and magnetic material, and a surface additive selected from silicon dioxide particles and ferrite particles, wherein the surface additive is applied to a surface of the composite particles.

13 Claims, No Drawings

EXTRUDABLE MAGNET COMPOUND WITH IMPROVED FLOW PROPERTIES

BACKGROUND OF THE INVENTION

1. Field of Invention

The present invention relates to extrudable magnets. More particularly the present invention relates to an extrudable magnet compound with improved flow properties in the extrusion processing equipment. Improved flow properties are provided by adding an external surface additive to the extrudate compound. The present invention also related to methods and materials for producing permanent extruded magnets.

2. Description of Related Art

Permanent magnets of a wide variety of design and made by a wide variety of methods are known in the art, and have been employed in a wide range of applications. For example, permanent magnets are known for use with various types of electric motors, holding devices and transducers, including loudspeakers and microphones. For many of these applications, the permanent magnets have a circular cross section constituting a plurality of arc segments comprising a circular permanent magnet assembly. Other cross-sectional shapes, including square, pentagonal and the like may also be used. With magnet assemblies of this type, and particularly those having a circular cross section, the magnet is typically characterized by anisotropic crystal alignment.

Various designs of permanent magnets have been produced by a number of different methods, including compression molding, injection molding and extrusion molding.

Compression molding is generally a method wherein a magnet composition comprising a magnetic powder and a thermosetting resin is filled into a mold in a press at room temperature. The composition is then compressed and heated to cure the resin, thereby molding a magnet. In the case of the compression molding method, since the resin content of the magnet composition is lower than that for the other molding methods, the freedom of shape in molding a magnet is smaller although the magnetic properties of the resultant magnet are often better.

Injection molding is a method wherein a magnet composition comprising a magnet power and a resin component is heat-melted to prepare a melt having sufficient fluidity. The melt is then injected into a mold where the melt is molded into a desired shape. In the case of the injection molding, in order to impart sufficient fluidity to the magnet composition, the resin content of the magnet composition is higher than that for the compression molding method, which often results in lowered magnetic properties. The freedom in molding, however, is generally higher than that for the compression molding method.

Extrusion molding is a method wherein a magnet composition comprising a magnet powder and a resin component is heat-melted to prepare a melt having sufficient fluidity. The melt is then formed into a desired shape by extruding the melt through a die. The melt is then set by cooling, thereby providing a product having a desired shape. In the extrusion method, like the injection molding method, the resin content needs to be high enough to impart the magnet composition the desired and necessary fluidity. An advantage of the extrusion method is that a thin-walled and long magnet can be easily produced.

Among the above methods, injection molding and extrusion generally use a thermoplastic resin as the resin. These are disclosed in Japanese Patent Laid-Open Nos. 123702/1987, 152107/1987, 194503/1985 and 211908/1985. These methods, and others, are also disclosed in U.S. Pat. Nos. 5,888,416, 5,047,205 and 4,881,984, the entire disclosures of which are incorporated herein by reference.

Accordingly, for various permanent magnet applications, it is known to produce a fully dense rod or bar of a permanent magnet alloy, which is then divided and otherwise fabricated into the desired magnet configuration. Such a bar can be formed by any of the above-described processes, although the extrusion method is particularly well suited for forming such a bar, as the process can be operated on a continuous basis.

A problem generally encountered in using the extrusion method, however, is that the material being extruded must exhibit good flow properties both in the granular material state and during processing, i.e., in the dynamic state wherein mechanical and thermal forces are applied to melt, mix, and move the "binder resin" and other additives through the processing equipment. For example, in the granular state, the material must be able to flow from the feed hopper into the extruder in a stable or uniform manner over time. If the flow is not stable and uniform, a problem can arise that material can cake on or adhere to the walls of the hopper. If the hopper is heated, as it often is, the caked material can solidify into solid chunks. These chunks can in turn further deteriorate or completely impede the flow of material into the extruder, and can result in unuseable extruded products. Similarly, and equally important, in the melted state the compound must flow properly in order to extrude into the proper shape.

To address the problem of flow properties, it is generally known to add various flow additives to the extrusion material. For example, it is known to add various calcium and/or zinc stearates to improve the flow properties of the material, in both the granular and the melted state. However, this approach is not always suitable in all applications due to potential unwanted side effects. For example, in the case of calcium stearates, a high temperature is required subsequent to extrusion to burn off any residual calcium from the product. However, these high burn-off temperatures can exceed the processing temperatures of the material, and thus either excess calcium must be tolerated, or the extruded material is degraded by the high temperatures. Similarly, in the case of zinc stearates, the zinc can be detrimental to the mechanical and magnetic properties of the material. Furthermore, zinc can be incompatible with some product materials, and can result in out gassing of chlorine gas. Additionally, incorporating the aforementioned flow additives into the bulk of the compound prior to granulation has little or no impact on the granular flow properties.

SUMMARY OF THE INVENTION

There is thus a need in the art for improved manufacturing methods and materials for producing high quality permanent magnets in a reliable process. In meeting this need, it is required that the process and materials be compatible with the processing equipment, without degrading the magnetic and other properties of the magnets being produced.

These and other objects are satisfied by the present invention, by adding an external additive to the extrudate material, to improve the flow properties of the material in the processing equipment, while at the same time not degrading performance characteristics. The additive thus improves the flow properties of the material, both in the granular and in the melted state. This is achieved in the present invention by using, as an external flow additive, materials such as, for example, extremely small particle size fumed silicon dioxide, commonly sold under the trade name AEROSIL, or a fine particle size ferrite.

More particularly, in embodiments, the present invention provides an extrudable magnet composition, comprising:

composite particles comprising thermoplastic resin and magnetic material, and a surface additive selected from the group consisting of fumed silicon dioxide (or AEROSIL) particles and ferrite particles, wherein said surface additive is applied to a surface of said composite particles.

The present invention also provides methods of making extrudable magnets using such a composition, and magnets made thereby and therefrom.

DETAILED DESCRIPTION OF PREFERRED EMBODIMENTS

Broadly, the method of the present invention provides for the production of a fully dense, or substantially so, permanent magnet alloy article by producing a particle charge of a permanent magnet alloy composition from which the article is to be made. The charge is placed in a container and the container is evacuated, sealed and heated to elevated temperature. It is then extruded to compact the charge to full density, or substantially to full density, to produce the desired fully dense article. Alternatively, or more preferably, the extrusion operation may be operated continuously, where extrusion (or a permanent magnet alloy composition) material is fed continuously or batch-wise into the extruder.

The permanent magnet composition according to the present invention generally comprises a magnet powder and a thermoplastic resin. The composition may further comprise effective amounts of one or more additives, such as about 0.1 to about 2.0 wt % of a chelating agent, about 0.1 to about 2.0 wt % of an antioxidant, about 0.1 to about 2.0 wt % of a solid lubricant (such as calcium stearate), and 0.01 to about 6 wt % of an AEROSIL or ferrite particle external surface flow additive. As is known in the art, a wide variety of other additives, including but not limited to surfactants, lubricants, flow additives, and the like, may be incorporated into the permanent magnet composition, in their known amounts for their known purposes.

The permanent magnet composition may contain one or more chelating agents, used in known amounts for their known effects. Suitable chelating agents include, but are not limited to, those having a phenol structure such as isopropylmalonic acid, phthalic acid, diethyltriamine, phenanthroline, glutamic acid, glycine, phenothiazine, N-Salicyloyl-N'-aldehydehydrazine, N-Salicyloyl-N'-acetylhydrazine, N,N-bis>3-(3,5-di-t-butyl-4-hydroxyphenyl)! Propionylhydrazine, N,N-Diphenyloxamide, and N,N-Hexamethylenebis(3,5-t-butyl-4-hydroxy-hydrocinnamide). When included, the chelating agent can be included in any desired amount, such as from about 0.1 to about 2.0 percent by weight, based on a weight of the total composition. Amounts outside this range can also be used, as desired.

The permanent magnet composition may also contain one or more antioxidants, used in known amounts for their known effects. Suitable antioxidants include, but are not limited to, hydrazine antioxidants, 4,4'-Butylidene-bis(3-methyl-6-t-butylphenol), 1,3,5-Trimethyl-2,4,6-tris(3,5-di-t-butyl-4-hydroxybenzyl)benzene, N,N'-Hexamethylene-bis (3,5-t-butyl-4-hydroxy-hydrocinnamide), and phenyl-beta-naphthylamine. When included, the antioxidant can be included in any desired amount, such as from about 0.1 to about 2.0 percent by weight, based on a weight of the total composition. Amounts outside this range can also be used, as desired.

In embodiments, when both a chelating agent and an antioxidant are included, it is preferred, although not required, that the total content of both the chelating agent and an antioxidant be from about 0.1 to about 2.0 percent by weight, based on a weight of the total composition. Incorporation of the chelating agent and an antioxidant generally help to ensure heat stability of the bonded magnet composition during kneading and molding, thereby enabling the composition to be stably molded. Further, they enable the volume percent of the magnet powder in the magnet composition to be optimized, improving the performance of the molded magnet. Furthermore, the chelating agent/antioxidant combination tends to inactivate the active magnetic powder, such as rare-earth magnetic powders, and, hence, improve the corrosion resistance of the resultant magnet.

With respect to the magnet material itself, any suitable permanent magnet material may be used, as desired. By way of example only, and without being limited thereto, suitable magnet powder materials include, but are not limited to, barium ferrite powder ($BaO \bullet 6Fe_2O_3$), strontium ferrite powder ($SrO \bullet 6Fe_2O_3$ ), barium-strontium ferrite powder ($Ba_xSr_{1-x}O \bullet 6Fe_2O_3$), $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, an Nd-Fe-B-based quenched magnetic powder (such as the product MQP-B manufactured by GM), ferrite particles, and the like. Any other suitable magnet material can also be used.

Preferably, in embodiments, the magnet material forms a major amount by weight of the total composition. Accordingly, in embodiments, the magnet material is included in an amount of from about 50 to about 99 percent by weight based on a total weight of the composition. Preferably, the magnet material is included in an amount of from about 75 to about 99 percent by weight, more preferably from about 85 to about 95 percent by weight, and even more preferably from about 87 to about 92 percent by weight, based on a total weight of the composition. However, amounts outside these ranges can be used, as desired.

In addition to the magnet material, the composition also includes one or more thermoplastic resins. Suitable thermoplastic resins include, but are not limited to, polyamide resin, such as polyamide-12 (nylon 12), polyamide-6 (nylon 6), polyamide-6,6 (nylon 6,6), and the like; polyvinyl chloride; plasticized polyvinyl chloride; polyphenylene sulfide; liquid crystalline polymers such as polyethemitrile; polyesters; rubber compositions such as natural rubber, polyurethane rubber, neoprene rubber, butadiene rubber, ASCIUM™, VITON™, HYPALON™, styrene-butadiene rubber (SBR), carboxylated SBR, acrylonitrile-butadiene rubber (NBR), butyl rubber, fluorinated rubber, chlorobutyl rubber, bromobutyl rubber, ethylene-propylene-diene rubber (EPDM), chlorinated polyethylene, chloro-sulfonated polyethylene, chloroprene, epichiorohydrin (ECO), isobutylene isoprene, isoprene, polysulfide, polyvinyl chloride-NBR, vinyl acetate ethylene, and the like; modified rubbers such as hydrogenated SBR, hydrogenated NBR, and carboxylated NBR; polyaramids (such as KEVLAR™, available from DuPont); polypropylene; polyvinyl alcohol; polypropylene oxide; silicone; mixtures thereof; and the like. Particular examples of some of the above materials include NIPOL™ 1052 NBR (available from Zeon, Louisville, Ky.), HYDRIN™ 2000

ECO (available from Zeon, Louisville, Ky.), HYPALON™ 48 (available from DuPont, Wilmington Del.), and NORDEL™ 2760P EPDM (available from DuPont, Wilmington Del.).

Preferably, in embodiments, the thermoplastic resin forms a minor amount by weight of the total composition. Accordingly, in embodiments, the thermoplastic resin is included in an amount of from about 1 to about 50 percent by weight based on a total weight of the composition. Preferably, the thermoplastic resin is included in an amount of from about 1 to about 25 percent by weight, more preferably from about 5 to about 15 percent by weight, and even more preferably from about 11 to about 13 percent by weight, based on a total weight of the composition. However, amounts outside these ranges can be used, as desired.

Generally, the various components used to form the extrudable composition are combined together and formed into small particles. This can be done either directly, where small particles are formed comprising all of the constituent materials. However, better results are generally obtained by first forming a large mass of material having all of the constituent materials except for the external flow additives, granulating the large mass of material to the desired smaller particle size of, for example, from about 0.5 to about 5 mm mean diameter range, and then adding the external flow additives, such as including the fine AEROSIL or ferrite additives of the present invention.

To improve the bulk flow and storage properties of the composition, one or more external solid flow additives may be incorporated unto the compound particles after granulation of the compound to the desired size range. According to the present invention, the flow additive includes at least fine silicon dioxide, such as fumed silicon dioxide, particles and/or fine ferrite particles. By "fine" herein is meant particles having an average particle diameter of less than about 5 microns, and preferably less than about 1 micron.

Examples of suitable silicon dioxide particles include, for example, but are not limited to, fumed silicon dioxide particles such as Aerosil R972™ and Aerosil R104™, both available from Degussa, Inc. If desired, although not required, the silicon dioxide particles can also be surface treated and/or functionalized, to provide different properties to the material. For example, if desired, the silicon dioxide particles can also be surface treated and/or functionalized to provide increased hydrophobicity to the aerosil.

Examples of suitable ferrite particles include, but are not limited to, BG-12™, available from Kane Magnetics; HM 170™, available from Hoosier Magnetics; and FM 201™, available from Toda America, Inc. In addition, any of the above-described magnet powder materials used to form the bulk material may also be used. Thus, the other examples of suitable ferrite particles include, but are not limited to, barium ferrite powder ($BaO{\bullet}6Fe_2O_3$), strontium ferrite powder ($SrO{\bullet}6Fe_2O_3$ ), barium-strontium ferrite powder ($Ba_xSr_{1-x}O{\bullet}6Fe_2O_3$), $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, an Nd-Fe-B-based quenched magnetic powder (such as the product MQP-B manufactured by GM), ferrite particles, and the like.

In embodiments, it is preferred that the external flow additives be the same material as the compound, or one of the constituent components of the magnetic compound particles, such as fine ferrite particles. In these embodiments, the magnetic properties of the entire composition will remain essentially unchanged, since the additive is also magnetic, although the bulk granulated material flow properties are improved.

According to the present invention, the flow additive is included in any suitable amount that provides the desired increased flow properties, while not rendering the composition unsuitable for its intended purposes. Thus, for example, the flow additive can be included in an amount of from about 0.01 or about 0.05 to about 5 or 6 percent by weight, based on a total weight of the entire composition. Preferably, the flow additive is included in an amount of from about 0.1 to about 3 percent by weight, more preferably from about 0.25 to about 2.0 percent by weight and even more preferably from about 0.5 to about 1.5 percent by weight, based on a total weight of the entire composition.

When the flow additive is incorporated into the composition, it can be added either as a separate component, or, preferably, as a surface treatment of other particles in the composition. For example, where the magnet material, thermoplastic resin, magnetic component, e.g. barium ferrite, other additives and the like are formed into small (such as, for example, from about 0.1 to about 10 mm diameter) particles, the flow additive can be included as a surface treatment or surface additive of the small particles. In this manner, the flow additive serves its finction generally by acting as a spacer or stilt particle, preventing the small particles of the composition from directly contacting each other, whereby they could tend to agglomerate.

Preferably, in embodiments of the present invention, the above-described flow additives are the only external flow additives added to the composition.

A particular benefit of the flow additives of the present invention is that they prevent agglomeration of the composition. This agglomeration prevention is evident not only during feeding into the extruder, but also during storage of the material. For example, without the inclusion of flow additive, the composition particles tend to agglomerate and solidify rather quickly. Thus, for example, a bulk material must generally be granulated on a daily basis, and only in an amount estimated to be used that day. If too much is granulated, agglomeration tends to set in, thus, rendering the material unuseable. However, with addition of flow additives according to the present invention, the granulated material is much more stable and less likely to agglomerate. The granulated materials thus have a longer useful lifetime.

An example is set forth hereinbelow and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE

A dry mix extrusion compound is formulated my mixing about 88% by weight barium strontium ferrite and about 12% by weight HYPALON-based binder to form a large mass of material. The HYPALON™ based binder includes HYPALON™ resin, available from DuPont, and other conventional additives. The dry mix compound is mixed on a heated roll mill to uniformly disperse and incorporate the barium strontium ferrite into the binder material. Subsequently, the compound is removed from the roll mill in large sheet form, the sheets approximately 3 to 5 mm thick, and allowed to cool. Next, the cooled slabs are granulated to a smaller particle size of, for example, from about 0.5 to about 5 mm mean diameter range.

The granulated material is separated into two batches. One batch is not further processed to incorporate a surface additive. Observation of the material shows that, without the addition of the external additive of the present invention, the granulated compound will solidify into a massive clump at room temperature within about a day and a half.

The second batch is processed to incorporate the surface treatment of the present invention. The granular material is loaded into a water cooled cavity mixing apparatus, along with about 1% by weight of the same barium strontium ferrite powder as used to incorporate into the compound as an external surface treatment. The combined materials are cooled mixed to uniformly disperse the surface treatment onto the surfaces of the granulated material. At this point, the coated compound granules can be transferred to a suitable container and stored until needed.

Observation of the second batch shows a significantly increased shelf-life of the granulated material. In particular, the granulated compound will not clump at all when stored for extended periods at room temperature. Additionally, the compound retains its granular form and does not clump even when exposed to temperatures of approximately 150° F. for periods exceeding 2 days.

Samples of the second batch and of the first batch prior to clumping are processed through a conventional magnet extruder device to form extruded magnets. Testing of the formed magnets show comparable operational results between the two compositions. This indicates that the surface treatment of the present invention does not adversely impact product characteristics.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. An extrudable magnet composition, comprising:

composite particles comprising thermoplastic resin and magnetic material, and a surface additive selected from the group consisting of silicon dioxide particles and ferrite particles, wherein said surface additive has an average particle diameter of about 5 micron or less, wherein said surface additive is applied to a surface of said composite particles, and wherein said composition comprises a major amount of said magnetic material and a minor amount of said thermoplastic resin.

2. The extrudable magnet composition of claim 1, wherein said thermoplastic resin is selected from the group consisting of polyamide resins, polyvinyl chloride, plasticized polyvinyl chloride, polyphenylene sulfide, liquid crystalline polymers, polyesters, rubbers, modified rubbers, polyaramids, polypropylene, polyvinyl alcohol, polypropylene oxide, silicone, and mixtures thereof.

3. The extrudable magnet composition of claim 1, wherein said thermoplastic resin is a rubber selected from the group consisting of natural rubber, polyurethane rubber, neoprene rubber, butadiene rubber, styrene-butadiene rubber (SBR), carboxylated SBR, acrylonitrile-butadiene rubber (NBR), butyl rubber, fluorinated rubber, chlorobutyl rubber, bromobutyl rubber, ethylene-propylene-diene rubber (EPDM), chlorinated polyethylene, chloro-sulfonated polyethylene, chloroprene, epichiorohydrin (ECO), isobutylene isoprene, isoprene, polysulfide, polyvinyl chloride-NBR, vinyl acetate ethylene, and mixtures thereof.

4. The extrudable magnet composition of claim 1, wherein said thermoplastic resin is a chloro-sulfonated polyethylene rubber.

5. The extrudable magnet composition of claim 1, wherein said magnetic material is selected from the group consisting of barium ferrite powder, strontium ferrite powder, barium-strontium ferrite powder, $SmCo_5$-based powder, $Sm_2Co_{17}$-based powder, $Nd_2Fe_{14}B$-based powder, $Sm_2Fe_{17}N_3$-based powder, $(NdDy)_{15}Fe_{79}B_6$, an Nd—Fe—B-based quenched magnetic powder, ferrite particles, and mixtures thereof.

6. The extrudable magnet composition of claim 1, wherein said magnetic material comprises ferrite particles.

7. The extrudable magnet composition of claim 1, further comprising at least one of from about 0.1 to about 2.0 wt % of a chelating agent, from about 0.1 to about 2.0 wt % of an antioxidant, and from 0.1 to about 2.0 wt % of a solid lubricant.

8. The extrudable magnet composition of claim 1, wherein said surface additive is silicon dioxide particles.

9. The extrudable magnet composition of claim 8, wherein said silicon dioxide particles are fumed silicon dioxide particles.

10. The extrudable magnet composition of claim 8, wherein said silicon dioxide particles are surface treated with hydrophobic functional groups.

11. The extrudable magnet composition of claim 1, wherein said surface additive is ferrite particles.

12. A method of forming an extruded magnet, comprising:

supplying a raw material from a feed hopper to an extruder, said raw material comprising the extrudable magnet composition of claim 1, and extruding said raw material through an extruder die to form said extruded magnet.

13. An extruded magnet made from the composition of claim 1.

* * * * *